US007798179B2

(12) United States Patent
Bruske

(10) Patent No.: US 7,798,179 B2
(45) Date of Patent: Sep. 21, 2010

(54) SPREADER WITH CLAMPING AND VENTILATING DEVICES

(75) Inventor: Johannes Bruske, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/603,196

(22) Filed: Oct. 21, 2009

(65) Prior Publication Data

US 2010/0101679 A1 Apr. 29, 2010

(30) Foreign Application Priority Data

Oct. 24, 2008 (EP) ..... 08167552

(51) Int. Cl.
*D03J 1/22* (2006.01)
*D03D 49/20* (2006.01)

(52) U.S. Cl. ..... 139/293; 139/291 R; 139/301; 139/316; 139/304; 139/294

(58) Field of Classification Search ..... 139/1 R, 139/1 B, 291 R, 293, 294–301, 304–316
See application file for complete search history.

(56) References Cited

U.S. PATENT DOCUMENTS 2,099,627 A * 11/1937 Rossman ..... 139/434
3,710,829 A * 1/1973 Johnson et al. ..... 139/304
3,805,850 A * 4/1974 Van Duynhoven et al. .. 139/1 E
3,861,428 A * 1/1975 Conte et al. ..... 139/439
3,881,523 A * 5/1975 Paton et al. ..... 139/436
3,900,051 A * 8/1975 Bucher ..... 139/25
3,929,168 A * 12/1975 Filter et al. ..... 139/99
4,146,061 A * 3/1979 Gotoh ..... 139/1 R
4,347,872 A * 9/1982 Brouwer et al. ..... 139/435.1
4,572,243 A * 2/1986 Felix ..... 139/97
4,781,222 A * 11/1988 van Bogaert et al. ..... 139/307
5,092,371 A * 3/1992 Vandeputte ..... 139/298
5,099,890 A * 3/1992 Duetsch et al. ..... 139/25
5,253,404 A * 10/1993 Weber et al. ..... 28/204
6,101,691 A * 8/2000 Pace et al. ..... 26/70

(Continued)

FOREIGN PATENT DOCUMENTS

DE 90 06 343.0 9/1990

(Continued)

*Primary Examiner*—Bobby H Muromoto, Jr
(74) *Attorney, Agent, or Firm*—Fitch, Even, Tabin & Flannery; Norman N. Kunitz

(57) ABSTRACT

A clamping device (18) for temporarily clamping the fabric (2) in place is provided on the weaving machine (1), and interacts with a ventilating device (23) that effects the temporary elimination of the clamping action. The operation of the ventilating device (23) is controlled by the movement of the beat-up device (11) via a mechanical connection that exists between the beat-up device (11) and the clamping device (18), and is effected by a mechanical transmission (28)—to be understood in the broadest terms—via which the clamping force can be eliminated or also generated in some embodiments. Due to the controlled release of the fabric at times or during phases of operation of the weaving machine (1) that can be adjusted and selected, a simple adaptation of the operation of the weaving machine (1) to different types of fabric can be achieved. An operation with less longitudinal pull of the fabric is possible. The clamping device (18) is suitable as a spreader device and can be adapted to various situations without great manual effort.

15 Claims, 3 Drawing Sheets

U.S. PATENT DOCUMENTS

| | | | | |
|---|---|---|---|---|
| 6,247,503 | B1 * | 6/2001 | Shaw et al. | 139/1 E |
| 6,691,744 | B1 * | 2/2004 | Birger | 139/450 |
| 7,140,399 | B2 * | 11/2006 | Bruske et al. | 139/55.1 |
| 2003/0075231 | A1 * | 4/2003 | Wendisch et al. | 139/304 |
| 2005/0028409 | A1 * | 2/2005 | McCabe | 38/143 |
| 2005/0056334 | A1 * | 3/2005 | Bruske et al. | 139/91 |
| 2006/0016504 | A1 * | 1/2006 | Kura et al. | 139/304 |
| 2007/0137719 | A1 * | 6/2007 | Pohl | 139/55.1 |
| 2008/0053555 | A1 * | 3/2008 | Cabulla et al. | 139/57 |
| 2008/0083472 | A1 * | 4/2008 | Binder | 139/1 E |
| 2008/0125266 | A1 * | 5/2008 | Pohl | 475/17 |
| 2008/0257443 | A1 * | 10/2008 | Khokar | 139/443 |

FOREIGN PATENT DOCUMENTS

| | | |
|---|---|---|
| DE | 10336769 | 3/2005 |
| EP | 1308546 | 10/2002 |
| GB | 944231 | 12/1963 |

* cited by examiner

SPREADER WITH CLAMPING AND VENTILATING DEVICES

CROSS-REFERENCE TO RELATED APPLICATION

This application claims the benefit of foreign priority under 35 U.S.C.§119 based on European Patent application No. 08 167 552.2, filed Oct. 24, 2008, the entire disclosure of which application is hereby incorporated by reference.

BACKGROUND OF THE INVENTION

The invention relates to a weaving machine comprising a spreader for the manufacture of a fabric.

The quality of fabrics produced on weaving machines is decisively affected by the goods spreader of the weaving machine, said spreader having the task of counter-acting the lateral shrinkage tendency of the fabric. To accomplish this, there are currently two types of spreaders that are used in practical applications, namely, the cylindrical spreader that is used to grasp and laterally stretch the fabric edge by means of rotatably supported wheels with pins in a positive-locking manner, and the rod spreader that is used to hold the fabric guided around a clamping rod that is located behind a slit defined in the spreader table. Such a rod spreader has been disclosed by document EP 1 308 546 B1, for example. This publication also discloses the possibility of replacing the rod spreader with a cylindrical clamping jaw that is pressed against a friction surface.

Cylindrical spreaders lead to a not always quite negligible stress of the manufactured fabric and can result in weaving flaws if the adjustment is wrong. Still, they have largely been successful. In contrast, rod spreaders are currently only used for a few types of fabric.

The operation of the spreader must be carefully adjusted to the fabric to be produced in order to ensure the desired fabric quality.

The rod spreader does not exert a laterally tensioning effect on the fabric. Consequently, said spreader can hold the fabric web only across a width prespecified by the reed and must thus be arranged in the immediate vicinity of the beat-up point or the fabric binding point. The fabric is clamped in place in the rod spreader due to the longitudinal pull exerted on the fabric. While the read comes into abutment, the fabric section—the so-called fabric leader—between the beat-up point and the rod spreader is pushed toward the rod spreader and thus briefly stops said spreader's clamping action. In this manner, the rod spreader operates in a manner that is gentle on the fabric and, as it were, in an independent automatic manner. However, this detachment operation must be carefully adjusted by means of the appropriate longitudinal pull and the appropriate clamping rod diameter. In so doing, varying the clamping rod diameter with a spreader profile that remains otherwise the same represents a relatively significant manual effort that can lead to considerable downtimes. In practical terms, a frequent exchange of the clamping rod in order to vary the force relationships on the goods spreader is thus out of the question.

Furthermore, rod spreaders do not have reverse motion capability. In case of warp thread breakages, trouble-shooting is usually required in that the fabric is briefly moved in reverse, the problem is eliminated, and the fabric is returned into its old position. This requires that the fabric transport may occur in forward and backward direction. However, for function-specific reasons, the rod spreader is only capable of intermittent transport only in forward direction at the time of weft beat-up.

Due to the aforementioned problems regarding the adjustment of the correct clamping force as a function of the correct fabric pull, rod spreaders have become less ubiquitous in the past, even though—in principle—a rod spreader is capable of holding the fabric in a non-destructive manner at a width that that has been prespecified by the reed, i.e., of preventing the fabric's lateral contraction. In contrast, cylindrical spreaders actively impart the fabric with a transverse tension and can thus result in high stress on the fabric.

Therefore, it is the object of the invention to provide a weaving machine with a goods spreader that is simple in construction, operates reliably and can be adjusted in the easiest possible manner.

SUMMARY OF THE INVENTION

The above object generally is achieved with the weaving machine in accordance with the invention that comprises a clamping device for keeping the manufactured fabric spread, with the clamping device comprising at least one clamping jaw that acts on at least one fabric edge. This clamping jaw may extend across the entire fabric width and act not only on the two fabric edges but, in addition, on the fabric located in between. It is also possible to configure the clamping jaw in such a manner that it acts only on at least one, preferably however two, fabric edges by clamping said edges against an abutment located on the other side of the fabric. Preferably, this clamping device is in the immediate vicinity of the fabric binding point, i.e., the fabric-side end position of the reed or a beat-up means. Thus, only a short fabric section (fabric leader) is formed between the fabric binding point and the clamping device, said section having a length of only a few millimeters to centimeters in warp thread direction.

The clamping device clamps the fabric across its entire width by clamping at least the edges and thus fixes the width prespecified by the reed or another beat-up means. In so doing, the clamping device prevents the lateral contraction of the fabric in a gentle manner.

The clamping device is associated with a ventilating device that is connected with the beat-up device by way of a mechanical transmission. The ventilating device is disposed to briefly release the clamping device at definable or prespecified times. To do so, the clamping jaw may be moved away from its abutment, or at least released therefrom, for at least a short period of time, so that the clamping force is clearly reduced or completely eliminated for the period of ventilation. It is also possible for the abutment to be moved away from the clamping jaw, in which case the clamping action on the fabric is eliminated. The time of activation of the ventilating device is preferably near the time of abutment of the beat-up means or the reed. The beat-up means is used to beat the weft thread on the fabric beat-up edge against the fabric leader. Preferably, during this operation or shortly thereafter, the clamping device can be briefly released by the ventilating device in order to move the fabric one step in warp thread direction. In so doing, the width of this step corresponds to a fabric length produced with one weft and beat-up in longitudinal warp thread direction. At the time, when the reed reaches the fabric binding point where the reed abuts against the weft thread, the ventilating device is preferably activated, in particular, because at this time the reed can take over the function of spreading the fabric.

Due to the mechanical connection between the ventilating device and the beat-up device, the operation of the ventilating device is synchronized in a phase-rigid manner with the operation of the beat-up means. Thus the ventilation of the clamping device no longer operates—as in the case of a rod spreader—in a self-controlled manner due to the push applied to the fabric leader but operates remote-controlled by the air ventilating device and thus in a defined manner and largely independent of the mechanical properties of the produced fabric. The adjustment of the clamping force, the time of ventilation, the duration of ventilation, the stroke of ventilation and the like can be accomplished without changing any clamping jaws or any other elements. To the extent that set-up measures need to be taken at all, they are by far easier to perform than in the case of known rod spreaders.

In addition, the present invention permits the targeted determination of a time relationship between the ventilation stroke and the beat-up point. Whereas in conventional rod spreaders the release of the clamping action of the rod spreader occurs automatically due to the beat-up operation and thus coincides with the latter from the viewpoint of time, the ventilating stroke in the inventive weaving machine can be set at a specifically defined time, for example, shortly after the beat-up of the weft thread. As a result of this, it is possible, for example, to manufacture fabrics with a particularly firm beat-up, i.e., very dense fabrics. A particularly large longitudinal pull of the fabric as would be necessary with rod spreaders in order to produce a high clamping force with the rod spreader is not required in the weaving machine in accordance with the invention. Considering this weaving machine, the clamping force applied by the clamping device is not derived from the longitudinal pull of the fabric as is the case with the rod spreader. Rather, the clamping force acting on the clamping jaw is generated by separate means, for example, by a spring means or another force-generating means that biases the clamping jaw against the fabric. Such spring means are, for example, mechanical springs such as, for example, tension springs, compression springs, leaf springs or the like, or by fluid cylinders such as, for example, hydraulic cylinders, pneumatic cylinders or the like.

Optionally, the spring means may be adjustable regarding their spring force. Preferably, however, adjustability may be omitted. In by far the most fabric types the size of the clamping force is of subordinate importance due to the force-controlled ventilation.

The concept of the invention also permits the targeted release of the clamping device for maintenance purposes, for example, in order to move the fabric in reverse for the correction of a mispick.

In addition, the weaving machine in accordance with the invention operates largely independently of the set number of revolutions, i.e., at least in view of the weft beat-up and the clamping device. Any clamping and releasing of the fabric in the spreader is not effected by the fabric itself but is forcibly effected by the ventilating device and thus functions the same way at gradually higher and higher operating speeds of the weaving machine.

By using several clamping devices that may be sequentially arranged, the contraction of the fabric can be prevented or reduced. In other words, the arrangement of several abutments and associate rods or clamping jaws can optimize or ensure the spreading of the fabric, even when the ventilating device has reduced or eliminated the clamping force.

It is also possible to arrange several rods parallel to each other or one after the other in a row in the direction of the warp thread, whereby the fabric loops around the rods in different directions, e.g., around the first rod in clockwise direction and around the second rod in counterclockwise direction. As a result of this, the reverse motion capability of the fabric is inhibited even when the ventilating device has eliminated the clamping force. Considering the arrangement of several rods in a row, one ventilating device and one clamping jaw at the rod closest to the fabric binding point can be sufficient.

Additional details of advantageous embodiments of the invention are the subject matter of the drawings, of the description or of the claims. The description is restricted to essential aspects of the invention and to miscellaneous situations. The drawings disclose additional details and may be used for supplementary information.

DETAILED DESCRIPTION OF THE INVENTION

Figures 1, 6:
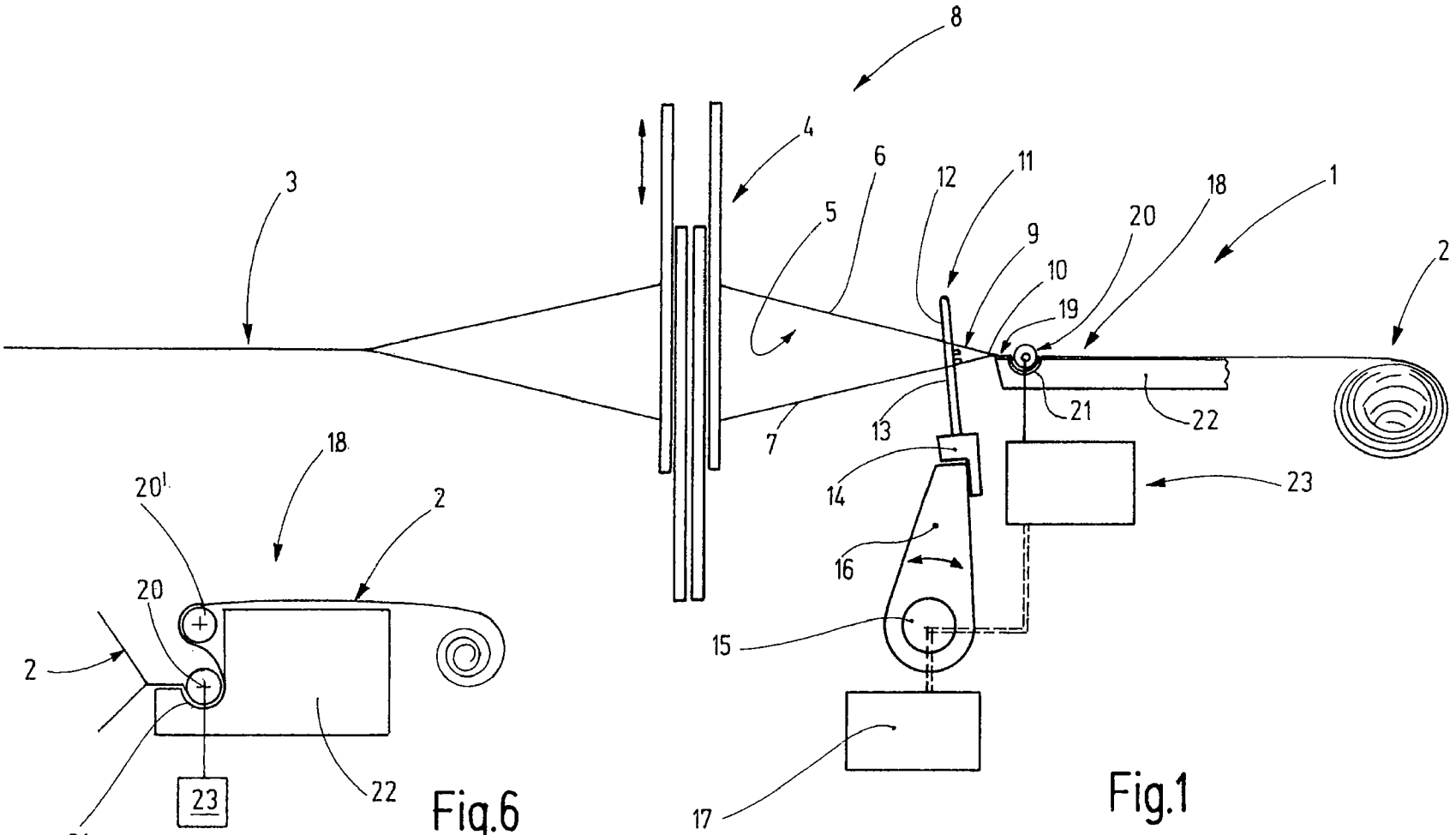
FIG. 1 is a detail of a simplified general illustration of the principle of a weaving machine.
FIGS. 3 through 6 are a general illustration of the beat-up device, the clamping device and the ventilating device, respectively, in various embodiments.

FIG. 1 shows a weaving machine 1 that is used for the manufacture of a fabric 2. To accomplish this, a warp thread bundle 3 is guided to heald shafts 4 by means of a not specifically illustrated warp beam, said heald shafts being disposed to form a shed 5 that is used for the weft input. To do so, respectively a few warp threads 6 of the bundle of warp threads are spread in vertical direction away from the other threads 7 of the warp thread bundle. In FIG. 1, the movement of the heald shafts 4 is indicated by an arrow.

The means that are used for driving the heald shafts are not specifically shown. Likewise, an illustration of the means used for weft input was omitted. In principle, however, all weft input means common in weaving machines may be used such as, for example, weft thread grippers, for example, rod grippers or web grippers, air jets, weaving shuttles or the like. Likewise, in order to form the shed it is possible to use any means suitable for shed formation such as, for example, the heald shafts 4, healds with various end eyelets, Jacquard healds or the like. In the present exemplary embodiment, the heald shafts 4 thus only are meant to illustrate various technical options for designing a means 8 for the formation of the shed 5.

For beating up the weft thread 9 that has been entered into the shed 5 at the fabric binding point or the beat-up edge 10, there is a beat-up means 11 that may be a reed 12, for example. The latter comprises a large number of individual blades 13 that are also referred to as leaf teeth or reed rods and are held on a batten 14. The blades 13 move into the interstices between the warp threads 6 and the interstices between the warp threads 7 that converge toward the beat-up edge 10. In so doing, the warp threads push the weft thread 9 against the beat-up edge 10 and abut there against said weft thread. The beat-up operation may be performed after each weft input or also after several weft inputs.

Preferably, the batten 14 is supported so as to be pivotable about an axis of rotation 15. The corresponding rockers 6 that connect the batten 14 with the swivel axis 15 are referred to as the "slay sword".

The batten 14 is driven so as to rock back and forth in a pivoting motion about the axis of rotation 15. The associate driving device 17 is schematically shown by FIG. 1. It is in effective mechanical communication with the rockers 16 and/or the axis of rotation 15. FIG. 1 shows the driving connection in a dashed double line. The driving device 17 may be a servomotor or the like that is provided as the drive for the beat-up means 11. This drive may be independent of the drive of the heald shafts 4 or any potential shed-forming means 8. For example, servomotors that are different but driven synchronously by a common control can be used for driving the shed-forming means 8 and the beat-up means 11. Considering an alternative embodiment, the driving device 17 may also be a central driving device that drives the shed-forming means 8, as well as the beat-up means 11.

Furthermore, the weaving machine 1 comprises a clamping device 18 that clamps the produced fabric 2 extending from the beat-up edge 10 in place in the vicinity of the beat-up edge 10. The clamping device 18 holds the fabric 2 against a pulling force applied to the fabric 2 in longitudinal direction, so that the fabric leader 19 existing between the clamping device 18 and the beat-up edge 10 provides a sufficiently firm abutment for the beat-up operation, i.e., for the weft thread 9.

The clamping device 18 comprises at least one clamping jaw 20 and one abutment 21, for example in the form or a flat or curved clamping surface of a table 22. Preferably, the surface of the abutment 21 is configured so as to be complementary to the clamping jaw 20. Preferably, the abutment 21 is arranged so as to be stationary. Alternatively, it may arranged so as to be movable, e.g., adjustable.

A ventilating device 23 is provided for moving the clamping device 18 into clamping position and into release position. This clamping device is disposed to temporarily, and in a controlled manner, reduce or overcome the force pushing the clamping jaw 20 against the abutment 21 and, optionally, move the clamping jaw 20 away from the abutment 21. The ventilating device 23 is in direct driving communication with the beat-up means 11 or its driving device 17. Consequently, the beat-up means 11 and the ventilating device 23 are driven by the same driving device 17.

Figure 2:
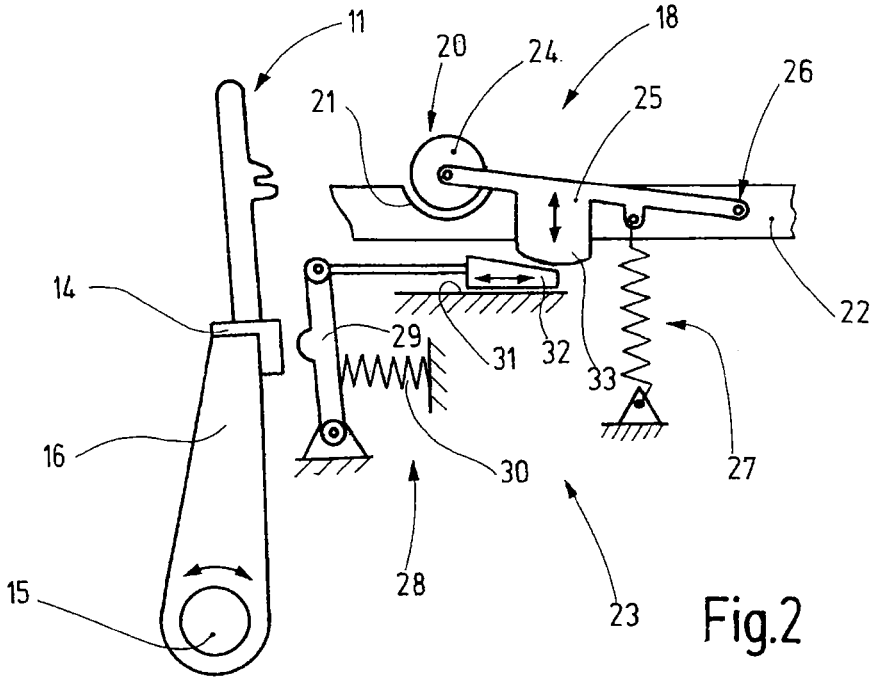
FIG. 2 is a general illustration of the beat-up device and the clamping device and the ventilating device in a first embodiment.

FIG. 2 shows one exemplary embodiment of the clamping device 28 and the ventilating device 23, for example.

The clamping jaw 20 has the form of a cylindrical roller or a cylindrical rod 24, for example. The rod 24 is oriented in a direction transverse to the longitudinal direction of the warp thread and extends across the width of the produced fabric 2. Thus, said rod is longer than the width of the fabric.

Preferably, the rod 24 is supported on a suitable carrier so as to be rotated without deceleration. The carrier is a frame 25, for example, that has arms on both sides of the spreader table 22, said arms having a length exceeding the diameter of the rod 24 and having the end 26 remote from the rod 24, said end being pivotally supported on a support that is stationary with respect to the table 22. Alternatively, the rod 24 may be rotated—beginning at the frame 25 or a suitable other support—in a decelerated manner or non-rotatable manner.

In addition to the clamping jaws 24 and the abutment 21, as well as optionally the frame 25, the clamping device 18 comprises, for example, one or more spring means 27 that are disposed to bias the clamping jaw 24 against the abutment 21. In so doing, the force of the spring means 27 is dimensioned in such a manner that a fabric clamped between the clamping jaw 20 and the abutment 21 cannot be moved forward by the longitudinal pull acting on the fabric and by the beat-up force applied by the beat-up means 11.

In order to promote the braking effect of the clamping jaw 20 it is also possible to permanently or temporarily inhibit or prevent said jaw's rotation on the frame 25. To do so, it is possible to use uncontrolled braking devices, for example, also in the form of friction bearings or a fixing device via which the clamping jaw 20 is non-rotatably supported on the frame 25. In this case, it is also possible to impart the clamping jaw 20, as well as the abutment 21, with a surface form that is different from the cylindrical form. It is also possible to temporarily release the braking device. For example, it is also possible, by means of an electrical actuation device, e.g., in the form of a pull-type electromagnet, to switch the braking device between an active state of high braking force and a passive state of lower or negligible braking force.

The ventilating device 23 that is associated with the clamping device 18 is set up to minimize or, as is preferred, overcome the force originating from the spring means 27 and biasing the clamping jaw 20 against the surface of the abutment 21. In the latter case, the ventilating device 23 may also act to minimally move—i.e., for example, by fractions of a millimeter or a few millimeters—the clamping jaw 20 away from the abutment 21 so that the clamping jaw 20 performs a "ventilating stroke". However, it is pointed out that the ventilating device 23 need not absolutely force such a ventilating stroke. In particular when the clamping jaw 20 is represented by the rotatably supported rod 24, it is sufficient to reduce the clamping force of the clamping device 18 in order to allow the longitudinal movement of the fabric.

Considering the present exemplary embodiment, the ventilating device 23 comprises a transmission 28 that, at least temporarily, establishes a force-transmitting connection between the axis of rotation 15, or any other component that is rigidly connected therewith such as rockers 16 or the batten 14, and the clamping jaw 20. Considering the present exemplary embodiment, the transmission 28 is a link mechanism, for example, comprising a pivotally supported lever 29 that can be pivoted by the batten 14 or the rockers 16 against the force of a spring 30 in order to shift a wedge 32 sliding on a stationary abutment 31 in a specified direction. The wedge 32 may be disposed to abut against a corresponding element 33 of the frame 25 in order to pivot the frame 25—if it is being shifted—against the force of the spring 27 and, in so doing, move the clamping jaw 20 away from the abutment 21.

FIG. 6 shows an exemplary embodiment of the clamping device 18 that comprises a second spreader roller 20' in addition to the clamping jaw 20 in the form of a spreader roller. The fabric 2 loops around the spreader rollers 20, 20', whereby the looping direction changes. For example, the fabric 2 loops around the spreader roller 20 in counterclockwise direction and around the spreader roller 20' in clockwise direction. As a result of this, the fabric experiences a certain inhibition, whereby the capability of reverse motion is reduced unless the abutment 21 interacts with the spreader roller 20, i.e., if the ventilating device 23 has eliminated or almost eliminated the force acting between the abutment 21 and the spreader roller 20. The action between the abutment 21 and the spreader roller 20 may occur due to the local shift of the spreader roller 20 relative to the abutment 21 or its table 22 or vice versa. As is demonstrated by this exemplary embodiment, the clamping device 18 comprises several—in this case two—spreader rollers 20, 20' and only one abutment 21 that is associated with the spreader roller 20. Other combinations of spreader rollers 20 and abutments 21 are also possible. The surface of the clamping jaws or spreader rollers may be configured in such a manner that—during the rotation of the spreader roller 20, 20'—the fabric 2 is subjected to forces that hold the fabric 2 spread. For example, the spreader rollers 20, 20' consist of steel having surface elevations that extend toward their ends, so that, during the rotation of the spreader rollers 20, 20', the fabric is kept spread. The direction of rotation of the elevations or the groove created by the elevations changes in the middle of the spreader roller 20, 20'. As a result of this, the forces holding the fabric 2 spread act in the direction of the fabric edges.

The weaving machine described so far operates as follows:

During operation of the weaving machine 1 in accordance with FIG. 1, the heald shafts 4 are moved up and down, either individually or in groups, in order to open and close the shed 5 with alternating warp threads 6, 7. With the shed 5 open, the weft thread 9 is introduced in the shed 5 in a direction transverse to the warp threads. Once this is done, the weft thread 9 is beat with the reed 12 against the beat-up edge 10 of the fabric 2. To do so, the driving device 17 causes a pivoting motion (clockwise in FIG. 1), so that the reed teeth 13 move between the warp threads 6, 7 and push one or more weft threads 9 (to the right in FIG. 1) until it (they) arrives (arrive) at the fabric binding point. It is at least over a part of the time of this operation that the clamping device 18 firmly holds the fabric.

At a given point in time, for example, shortly after the abutment of abutment of the warp thread or also still during the abutment, the ventilating device 23 is activated. Said ventilating device causes the clamping force acting between the clamping jaw 20 and the abutment 21 and firmly holding the fabric 2 to be at least partially compensated for, preferably, however, eliminated and overcome. Considering the embodiment in accordance with FIG. 2, this is achieved, for example, in that the wedge 32 is moved far enough to the right that the rod 24 is lifted by a few tenths of a millimeter. In so doing, the fabric is briefly released and can be pushed forward one step by the reed 12. The length of this step corresponds, for example, to the length of the fabric section to be measured in longitudinal direction of the warp thread, said fabric section being produced with the weft threads that are to be beaten up. Preferably, while the beat-up means 11 is in contact with the beat-up edge 10, the ventilating device 23 stops the clamping of the fabric 2, in which case then the abutment means 11 takes over the function of spreading the fabric 2.

Figure 3:
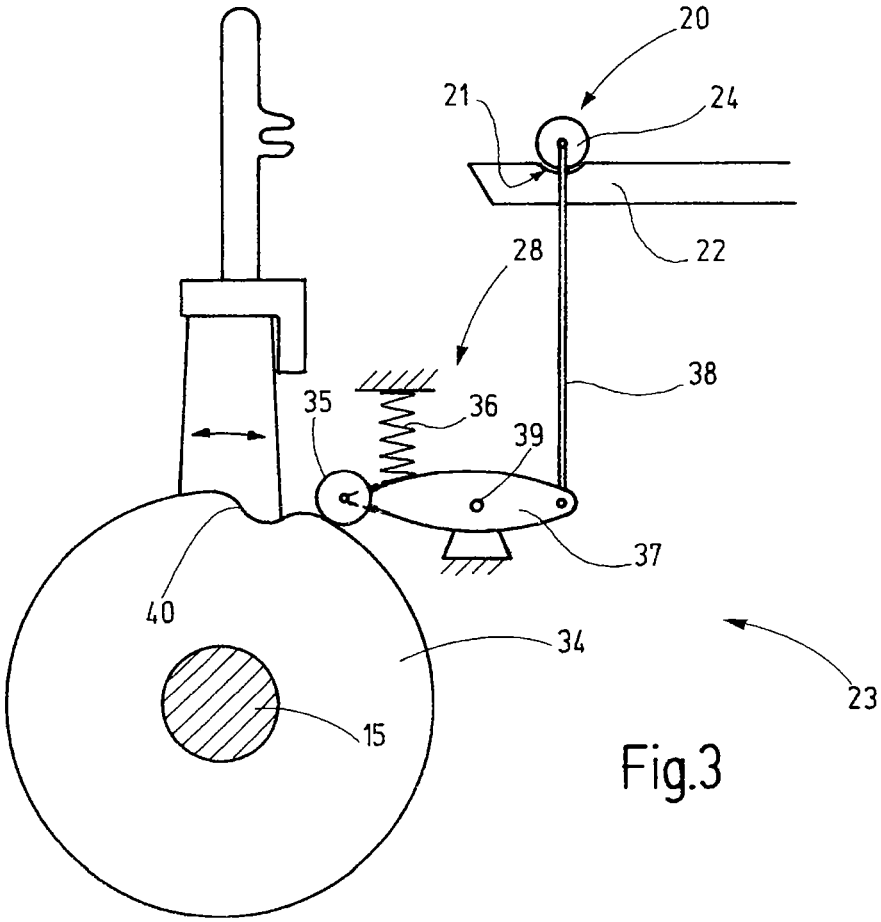

The ventilating device 23 may be designed in many different ways. For example, in accordance with FIG. 3, it may comprise a cam 34 connected with the axis of rotation 15 in the manner of a cam plate and a cam follower 35 that, for example is pushed by the force of a spring 36 against the periphery of the cam 34. The movement of the cam follower 35 can be transmitted via a lever 37 and the pulling means 38 to the clamping jaw 20. In turn, said clamping jaw is represented by the cylindrical rod 24. Other than that the previous description applies analogously.

Considering the present embodiment, the transmission 28 comprises the cam 34, the cam follower 35, the two-arm lever 27 that is designed as a rocker, for example, said lever being supported so as to be pivotable about a stationary center of rotation 39, and the pulling means 38, as well as the spring 36. In this case, the ventilating device 23 provides the force for pushing the clamping jaw 20 against the abutment 21 as well as the force for ventilating. The clamping force is actively generated in that the cam 34 displaces the cam follower 35 radially away from the axis of rotation 15. The ventilating stroke is generated by an indentation 40 on the circumference of the cam 34. In the present case, the ventilating stroke is effected by the spring 36.

Figure 4:
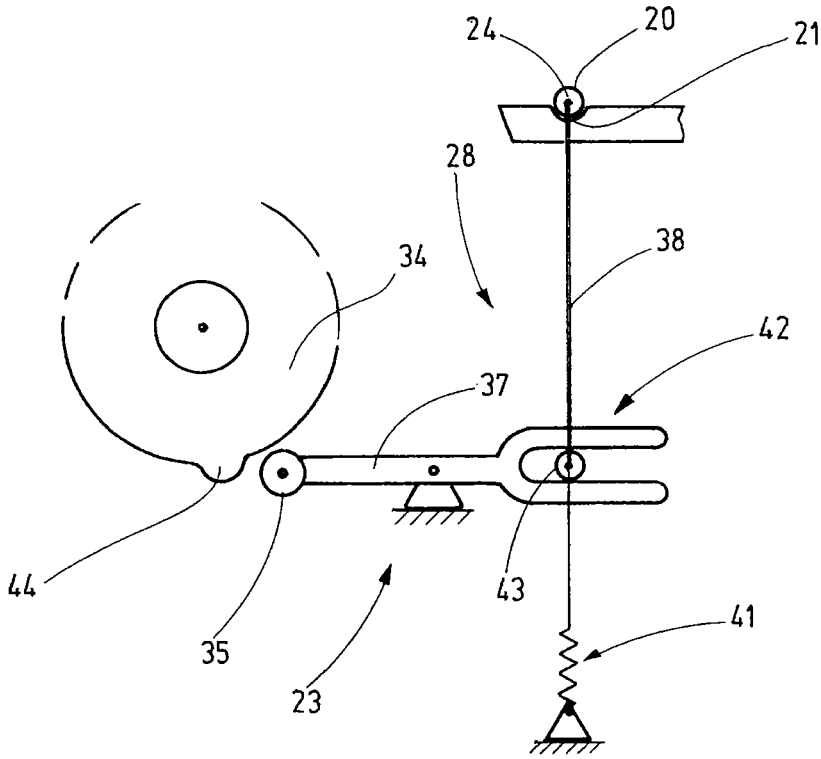

FIG. 4 shows another embodiment of the ventilating device 23. The clamping jaw 20 is biased via the pulling means 38 and a tension spring 41 against the abutment 21. The pulling means 38 in the form of a thin strip or rod comes into contact with the end faces of the clamping jaw 20 as in the previous exemplary embodiment. In turn, said clamping jaw may be configured as a cylindrical rod 24. The clamping force is generated by the tension spring 41.

Considering this exemplary embodiment, the transmission 23 again comprises a cam 34, a cam follower 35, for example, in the form of a roller that is rotatably supported and moves on the circumference of the cam 34, said roller being supported on one end of the two-arm lever 37, and a clutch 42 which allows the lever 37 to transmit a ventilating stroke to the pulling means 38. As shown, the clutch 42 may be represented by an elongated opening in the lever 37, whereby a link block 43 connected with the pulling means 38 is seated in said elongated opening or connected in any other suitable way.

Considering this exemplary embodiment, the clamping force is provided by the tension spring 41 while a radial elevation 44 of the cam 34 effects the ventilating stroke of the clamping jaw 24.

Figure 5:
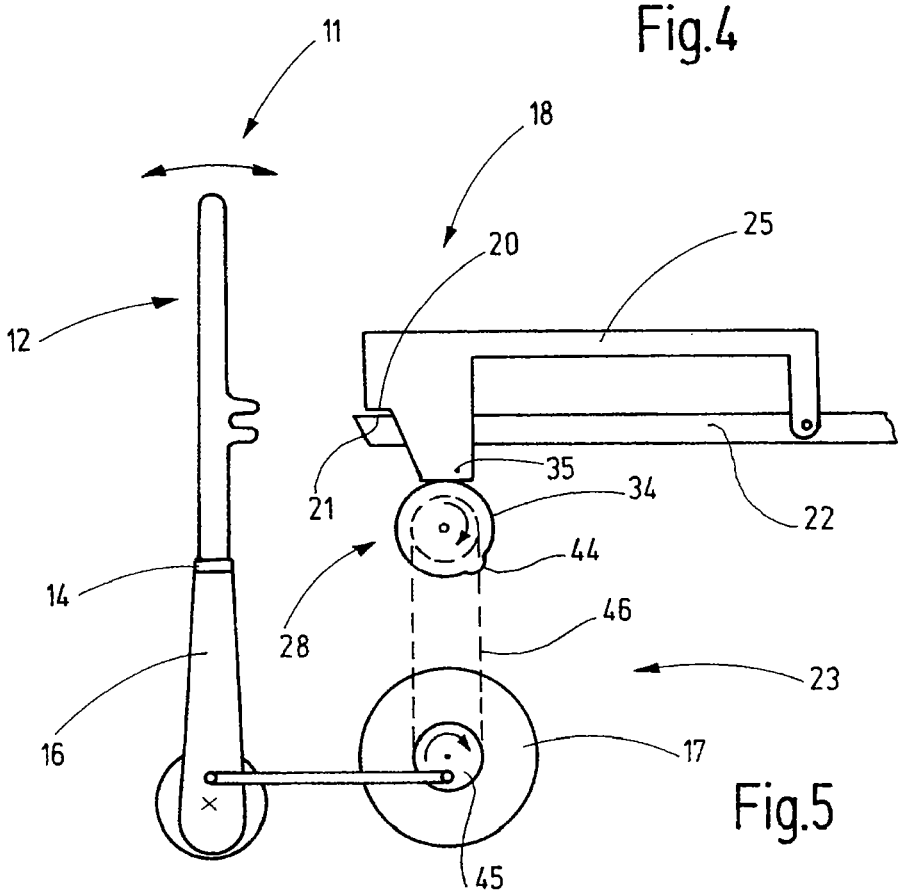

Another modified embodiment of the clamping device 18 and the ventilating device 23 is obvious from FIG. 5. In this case, the driving device 17 comprises a rotary driving device, for example, a servomotor. The latter may comprise an eccentric 45 at its output, for example, said eccentric imparting the rockers 16, the batten 14 and the reed 12 with an oscillating movement as indicated by the arrow in FIG. 5. In addition, the driving device 17 may be connected directly or, as illustrated, via a pulling means gearing 46 or any other gearing with the cam 34 that is in abutment with the cam follower 35. The cam follower 35 may be directly connected with the frame 25 whose clamping jaw 20—in this exemplary embodiment—may consist of a flat or even slightly bulging surface seated on the frame 25. In this exemplary embodiment, the abutment 21 is represented by a preferably flat surface section of the upper side of the table 22.

While the clamping jaw 20 in each of the so far described embodiments presses from the top on the fabric 2, and the abutment 21 is arranged below the fabric 2, the clamping jaw may also be arranged below the fabric 21. Then, the abutment is rigidly or also movably arranged above the fabric.

During operation, the driving device 17 effects a back and forth oscillating movement of the reed 12 and synchronizes therewith the occasional lifting of the cam follower 35 and thus the lifting of the clamping jaw 20 off the fabric that is located between the clamping jaw 20 and the abutment 21. To accomplish this, the cam 34 has the elevation 44. By not specifically illustrated means, for example suitable spring means, the frame 25 is otherwise biased downward so that the fabric is clamped in place between the clamping jaw 20 and the abutment 21. Alternatively, this may also be accomplished, for example, by a clamping cam that is designed to be complementary to the cam 34.

The details of the design of the different embodiments can be combined with each other. For example, considering the embodiment in accordance with FIG. 5, the clamping jaws 20 and the abutment 21 can be alternatively configured as in one of the other embodiments. In addition, all the embodiments have in common that the phase relationship, i.e., the period adjustment between the moment of elimination of the clamping force ("ventilating stroke") and the movement of impingement of the reed 12 on the beat-up edge 10 can be configured so as to be adjustable. This is possible, for example, by rotating the cam 34 relative to the shaft driving said cam. All the described embodiments have in common that the clamping device 18 is mechanically coupled with the batten 12. Furthermore, they have in common that a ventilating device 23 is provided that at least partially eliminates the clamping action of the clamping device 18 in a manner that is cyclically repetitive relative to specific phases of operation of the weaving machine 1. The ventilating device 23 can be activated, e.g., during or after each beat-up operation. Alternatively, said ventilating device can be activated after a few beat-up operations during a then subsequent beat-up operation or after said beat-up operation.

A clamping device 18 for temporarily clamping the fabric 2 in place is provided on the weaving machine 1 in accordance with the invention, whereby said clamping device interacts with a ventilating device 23. The ventilating device 23 effects the temporary elimination of the clamping action. The operation of the ventilating device 23 is controlled by the movement of the beat-up means 11. Preferably, to accomplish this, a mechanical connection exists between the beat-up means 11 and the clamping device 18. This connection is effected by a mechanical transmission 28—said transmission to be understood in the broadest terms—via which the clamping force can be eliminated or also generated in some embodiments. Due to the controlled release of the fabric at times or during phases of operation of the weaving machine 1 that can be adjusted and selected, a simple adaptation of the operation of the weaving machine 1 to different types of fabric can be achieved. An operation with less longitudinal pull of the fabric is possible. The clamping device 18 in accordance with the invention is suitable as a spreader device and can be adapted to various situations without great manual effort.

It will be appreciated that the above description of the present invention is susceptible to various modifications and changes, and the same are intended to be comprehended within the meaning and range of equivalents of the appended claims.

LIST OF REFERENCE NUMERALS

1 Weaving machine
2 Fabric
3 Bundle of warp threads
4 Heald shafts
5 Shed
6, 7 Warp threads
8 Shed-forming means
9 Weft thread
10 Beat-up edge
11 Beat-up means
12 Reed
13 Reed teeth, reed rods
14 Batten
15 Rotational axis
16 Rockers
17 Driving device
18 Clamping device
19 Fabric leader
20, 20' Clamping jaws, spreader roller
21 Abutment
22 Table
23 Ventilating device
24 Rod
25 Frame
26 End
27 Spring means
28 Transmission
29 Lever
30 Spring
31 Abutment
32 Wedge
33 Element
34 Cam
35 Cam follower
36 Spring
37 Lever
38 Pulling means
39 Center of rotation
40 Indentation
41 Tension spring
42 Clutch
43 Link block
44 Elevation
45 Eccentric
46 Pulling means gearing

What is claimed is:

1. Weaving machine (1) for the manufacture of a fabric (2) consisting of warp threads (6, 7) and weft threads (9), said weaving machine comprising:

means (8) for the formation of a shed (5), a beat-up means (11) for beating up weft threads (9) that have been introduced in the shed (5), a clamping device (18) that comprises at least one clamping jaw (20) acting on at least the fabric edge, a ventilating device (23) set up for the controlled release of the clamping device (18), and a mechanical transmission (28) via which the ventilating device (23) is connected with the beat-up means (11) in a mechanical, hydraulic or pneumatic manner.

2. Weaving machine in accordance with claim 1, characterized in that the beat-up means (11) is in driving connection with the ventilating device (23).

3. Weaving machine in accordance with claim 1, characterized in that said weaving machine comprises a main driving device (17) that is in driving connection with the beat-up means (11).

4. Weaving machine in accordance with claim 1, characterized in that the clamping device (18) is associated with a spring means (27, 36) in order to bias the clamping jaw (20) against the fabric (2).

5. Weaving machine in accordance with claim 1, characterized in that the transmission (28) is a cam-follower transmission (34, 35).

6. Weaving machine in accordance with claim 5, characterized in that the transmission (28) comprises an opening cam (34) for moving the clamping jaw (20) away from the fabric (2).

7. Weaving machine in accordance with claim 5, characterized in that the transmission (28) comprises a closing cam (34) for pushing the clamping jaw (20) toward the fabric (2).

8. Weaving machine in accordance with claim 1, characterized in that an abutment (21) is arranged opposite the clamping jaw (20).

9. Weaving machine in accordance with claim 8, characterized in that the abutment (21) is stationary on a spreader table (22).

10. Weaving machine in accordance with claim 1, characterized in that the clamping jaw (20) has a rounded clamping surface.

11. Weaving machine in accordance with claim 1, characterized in that the clamping jaw (20) has a cylindrical form.

12. Weaving machine in accordance with claim 1, characterized in that the clamping jaw (20) is rotatably supported on a frame (25).

13. Weaving machine in accordance with claim 1, characterized in that the clamping jaw (20) is supported so as to be movable toward the abutment (21) and away from said abutment.

14. Weaving machine in accordance with claim 1, characterized in that the beat-up means (11) is a reed (12) that is held on a batten (14).

15. Weaving machine in accordance with claim 1, characterized in that the clamping device (18) comprises two spreader rollers (20, 20'), wherein the fabric (2) alternately loops around these two spreader rollers (20, 20') and wherein only one spreader roller (20) is associated with an abutment (21).

* * * * *